US009943720B2

(12) United States Patent
Holness

(10) Patent No.: US 9,943,720 B2
(45) **Date of Patent: *Apr. 17, 2018**

(54) APPARATUS FOR ISOMETRIC AND INCREMENTAL MUSCLE CONTRACTIONS

(71) Applicant: Wilfred Holness, New York, NY (US)

(72) Inventor: Wilfred Holness, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/001,076

(22) Filed: Jan. 19, 2016

(65) Prior Publication Data

US 2016/0296786 A1 Oct. 13, 2016

Related U.S. Application Data

(63) Continuation of application No. 11/204,754, filed on Aug. 15, 2005, now Pat. No. 9,278,254.

(51) Int. Cl.

| | |
|---|---|
| ***A63B 24/00*** | (2006.01) |
| ***A63B 15/02*** | (2006.01) |
| ***A63B 71/00*** | (2006.01) |
| ***A63B 21/005*** | (2006.01) |
| ***A63B 21/00*** | (2006.01) |
| ***A63B 21/002*** | (2006.01) |
| ***A63B 21/078*** | (2006.01) |
| ***A63B 23/12*** | (2006.01) |
| ***A63B 21/062*** | (2006.01) |
| ***A63B 23/035*** | (2006.01) |

(Continued)

(52) U.S. Cl.

CPC ..... *A63B 21/154* (2013.01); *A63B 21/0023* (2013.01); *A63B 21/0056* (2013.01); *A63B 21/0628* (2015.10); *A63B 21/078* (2013.01); *A63B 23/03516* (2013.01); *A63B 23/0494* (2013.01); *A63B 23/12* (2013.01); *A63B 23/1263* (2013.01); *A63B 24/00* (2013.01); *A63B 21/008* (2013.01); *A63B 21/0085* (2013.01); *A63B 23/0405* (2013.01); *A63B 23/1281* (2013.01); *A63B 2220/13* (2013.01); *A63B 2220/16* (2013.01)

(58) Field of Classification Search

CPC ..... A63B 21/154; A63B 23/03516; A63B 21/0628; A63B 23/1263; A63B 21/0023; A63B 24/00; A63B 23/0494; A63B 23/12; A63B 21/078; A63B 21/0056; A63B 21/008; A63B 23/1281; A63B 23/0405; A63B 2220/13; A63B 2220/16; A63B 21/0085

See application file for complete search history.

(56) References Cited

U.S. PATENT DOCUMENTS 3,973,251 A * 8/1976 Stephans ..... A61B 5/22 200/38 B
4,728,101 A * 3/1988 King ..... A63B 21/0087 482/112

(Continued)

*Primary Examiner* — Sundhara Ganesan
*Assistant Examiner* — Shila Jalalzadeh Abyane
(74) *Attorney, Agent, or Firm* — Wilfred Holness

(57) ABSTRACT

A resistance exercise apparatus comprising a mechanism for allowing the machine to inhibit in intervals along a range of motion for an amount of time, movement in a direction caused by an external force applied to a movable surface on the machine, while allowing movement of the surface in the opposite direction to the external force, wherein said movable surface is linked to a resistance source.

20 Claims, 16 Drawing Sheets

(51) Int. Cl.
*A63B 21/008* (2006.01)
*A63B 23/04* (2006.01)

(56) References Cited

U.S. PATENT DOCUMENTS 4,765,613 A * 8/1988 Voris ..... A63B 21/0056 482/137
4,822,037 A * 4/1989 Makansi ..... A63B 21/0056 482/6
4,979,735 A * 12/1990 Stewart ..... A63B 21/00069 482/111
5,195,746 A * 3/1993 Boyd ..... A47C 15/004 434/29
5,387,171 A * 2/1995 Casey ..... A63B 21/0552 482/130
5,556,362 A * 9/1996 Whipps ..... A63B 21/063 482/97
5,643,151 A * 7/1997 Naimo ..... A63B 21/063 482/93
5,722,921 A * 3/1998 Simonson ..... A63B 21/155 482/100
6,120,416 A * 9/2000 Walker ..... A63B 21/0023 482/51
6,234,939 B1 * 5/2001 Moser ..... A63B 22/0007 482/57
6,428,139 B1 * 8/2002 Silverbrook ..... B41J 2/2128 347/19
6,436,013 B1 * 8/2002 Krull ..... A63B 21/063 482/94
6,482,128 B1 * 11/2002 Michalow ..... A63B 69/0028 482/100
7,160,042 B2 * 1/2007 Burrell, IV ..... G05B 19/02 400/472
2002/0025888 A1 * 2/2002 Germanton ..... A63B 21/063 482/1
2002/0091043 A1 * 7/2002 Rexach ..... A63B 21/156 482/98
2003/0211916 A1 * 11/2003 Capuano ..... A63B 21/072 482/8
2005/0239602 A1 * 10/2005 Cordova ..... A63B 21/00072 482/1

* cited by examiner

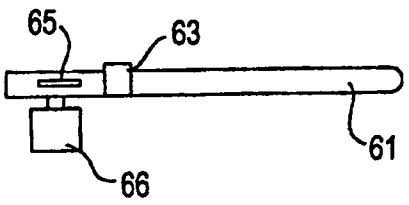
FIG. 6
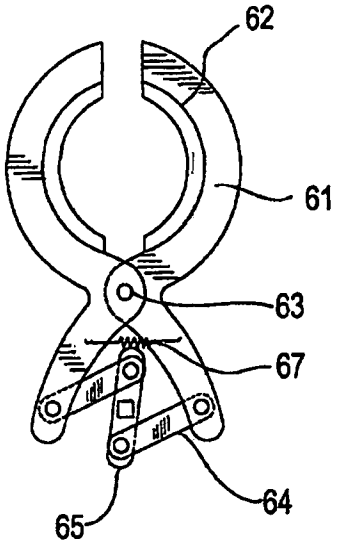

APPARATUS FOR ISOMETRIC AND INCREMENTAL MUSCLE CONTRACTIONS

CROSS-REFERENCE TO RELATED APPLICATIONS

This application is a Continuation Application of U.S. patent application Ser. No. 11/204,754, filed on Aug. 15, 2005.

FEDERALLY SPONSORED RESEARCH

Not Applicable

SEQUENCE LISTING OR PROGRAM

Not Applicable

FIELD OF INVENTION

This invention relates to exercise apparatus in particular resistance exercise apparatus.

BACKGROUND

The primary focus of many resistance exercise machine builders has been the design of exercise machines so that the angle of motion of these machines maximizes the machine's effect on the targeted muscle or muscles. These machines have emulated movements that target various muscles and muscle groups. They are able to apply a given resistance through a weighted plate pulley system, weighted plates with sliding tubes, U.S. Pat. No. 6,436,013, flexible material, U.S. Pat. No. 5,387,171, springs, leverage systems, hydraulic, U.S. Pat. No. 4,979,735, pneumatic, U.S. Pat. No. 4,728,101, braking systems, U.S. Pat. No. 4,822,037 and such the like—a resistance source.

Some machines have focused on providing a variable-resistance mechanism along the range of motion of the exercise being performed. Some of these variable-resistance machines use a cam with variable radii or cam profile. With this mechanism, as the cam rotates it varies the mechanical advantage the user has at different points along the range of motion. This type of mechanism is commonly associated with Nautilus type machines. Other resistance exercise machine use a weighted leverage arm (pivot-type machines).

Most resistance exercise machines, including those with the afore-mentioned variable-resistance mechanism, use a tether such as a wire cable, a chain, a belt, or the like connected to an attached resistance. This attached resistance source is itself, in most cases, adjustable so as to increase or decrease the resistance along the range of motion of the exercise being performed. The increase and decrease in resistance can easily be performed with a weight stack by placing the pin in the stack at the desired weight setting. With the more modern machines, a user merely punches in the desired level of resistance. These variable-resistance exercise machines with means for selecting the degree of resistance are common throughout the exercise machine industry.

Weight machines are also used in the rehabilitation field. In this field it is important the patient receives the benefit of resistance training over a limited or if possible a full range of motion for the given exercise. Some machines have focused on limiting the range of the exercise. These machines may be useful for rehabilitation since they may prevent further injury by limiting the range of motion, U.S. Pat. No. 5,722,921.

Other machine builders have focused on isokinetic machines. These machines focus on a constant speed with variable workload or accommodating resistance. With these machines the user is forced to perform the exercise along a range of motion within a given time frame. These machines are kinetic in nature and do not provide for isometric exercise.

All of the afore-mentioned machines and those heretofore known do not focus on exercising the muscle or muscles isometrically and forcing the muscle or muscles to overcome inertia during and along the range of motion of an exercise being performed and thus do not focus on isometric and incremental muscle contraction during a repetition.

The benefits of resisted muscle contraction exercises and isometric exercise have been known. Isometric and resisted muscle contraction has been shown to induce muscle hypertrophy and increase muscle growth factors (Skeletal muscle hypertrophy in response to isometric, lengthening, and shortening training bouts of equivalent duration. J Appl Physiol. May 2004; 96(5):1613-8.). However, there is no exercise machine designed for the user to perform an isometric and incremental contraction or an incremental and isometric contraction along the range of motion of the exercise performed.

Thus, there remains a need for an exercise apparatus that works the targeted muscle or muscle groups isometrically and concentrically during and along a range of motion of an exercise being performed on the exercise apparatus.

BRIEF SUMMARY

In accordance with the present invention an apparatus which inhibits movement of a movable surface on a resistance exercise apparatus, for an amount of time, while the apparatus allows movement of the movable surface in the other direction. Wherein, the movable surface is linked to a resistance source. The movement of the surface, with regard to this invention, is that which is opposite the direction of the force of the resistance source. The user applies an external force opposite the force of the resistance source, which causes the movable surface to move in the direction of the applied external force. The movement of the movable surface referred to in the invention is diametric to the resistance force. As the movable surface moves a certain distance, a mechanism inhibits movement of the movable surface in the direction of the external force for an amount of time, and then the inhibition is removed.

BRIEF DESCRIPTION OF DRAWINGS—FIGURES

FIG. 6 shows an electric brake clamp.

DRAWINGS—REFERENCE NUMERALS

Figure 1A:
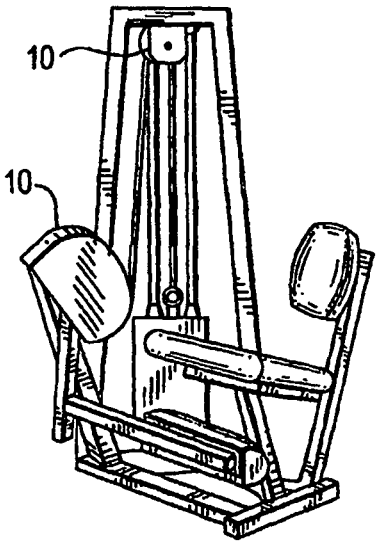
FIGS. 1A to 1C show where on a cam-type resistance machine, a pulley-type resistance machine and a tube-type resistance machine a mechanism to inhibit movement in a direction for an amount of time may be located.

10 outer wheel; 12 bar code; 13 opto interrupter sensor triggering disc; 14 sensor detectable protrusion; 16 switch activating protrusion; 18 outer inhibitory contact plate; 20 bar code reader' 21 processor; 22 user-defined input; 24 opto interrupter sensor; 25 snap action sensor switch; 26 interval timer; 30 electric brake; 32 brake shoe; 40 brake drum; 42 inner inhibitory contact plate; 44 recoil spring; 50 sleeve; 52 horizontal bar; 54 sleeve guide; 60 electric clamp brake; 61 brake housing; 62 brake pad; 63 axis bolt; 64 brake arm; 65 brake yolk; 66 rotary solenoid; 70 solenoid; 80 activity inhibition indicator.

Nomenclature

DETAILED DESCRIPTION

The present invention will now be described more fully with reference to the accompanying drawings in which the preferred embodiment of the invention is shown. This invention may however be embodied in many different forms and should not be construed as limited to the embodiment set forth herein. Rather, the embodiment is provided so that this disclosure will be thorough and fully convey the scope of the invention to those skilled in the art. Like numbers in the drawings refer to like elements throughout.

I an aspect of this invention, this invention provides an apparatus such as a resistance exercise machine which comprises a mechanism for allowing the apparatus to inhibit in intervals along a range of motion for an amount of time, movement of a movable surface on the apparatus in a direction caused by an external force applied to the movable surface, while the apparatus allows uninhibited movement of the movable surface in the opposite direction to the external force, and wherein the movable surface is linked to a resistance source which applies force which is diametric to the external applied force.

In a first embodiment of this invention, the invention is an exercise machine.

In a second and a preferred embodiment of this invention, the invention is a resistance exercise apparatus. In the embodiment, the resistance exercise apparatus contains a mechanism for allowing the apparatus to inhibit in intervals along a range of motion for an amount of time, movement in a direction caused by an external force applied to a movable surface on the apparatus. The movement of the surface, with regard to the invention, is the movement that is opposed by the apparatus' resistance source. The apparatus inhibits the movable surface only in the direction of the external force and not in the direction of the resistance source's force.

Figure 1B:
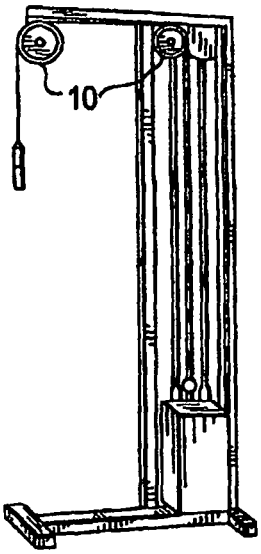
Figure 1C:
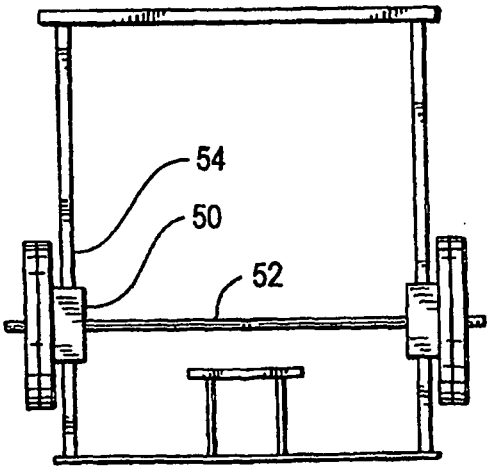

In the embodiment the external force is the force applied by a user of the apparatus to a movable surface on the apparatus. The movable surface is linked to a resistance source. Possible locations of the mechanism to inhibit unidirectional movement of the movable surface are illustrated in FIGS. 1A to 1C. FIG. 1A shows a typical cam-type exercise machine. The mechanism to inhibit unidirectional movement of the movable surface in the lever-type or cam-type exercise machine may be located at the hub of the cam or pivot. Likewise, the mechanism to inhibit unidirectional movement of the movable surface may be located at the hub of a pulley, as is shown in FIG. 1B. Further, any pulley along the path of the tether can be used to inhibit movement during the exercise. FIG. 1C shows where the mechanism to inhibit unidirectional movement of the movable surface may be located on a tube-type exercise machine. In the tube-type exercise machine, as in a Smith machine, a tether may also be linked to the movable surface. The tether may then pass over a pulley, cam or a rotational device. In such cases the mechanism may also be linked to the pulley or the mechanism may inhibit directly unidirectional movement of the tether.

Figure 2:
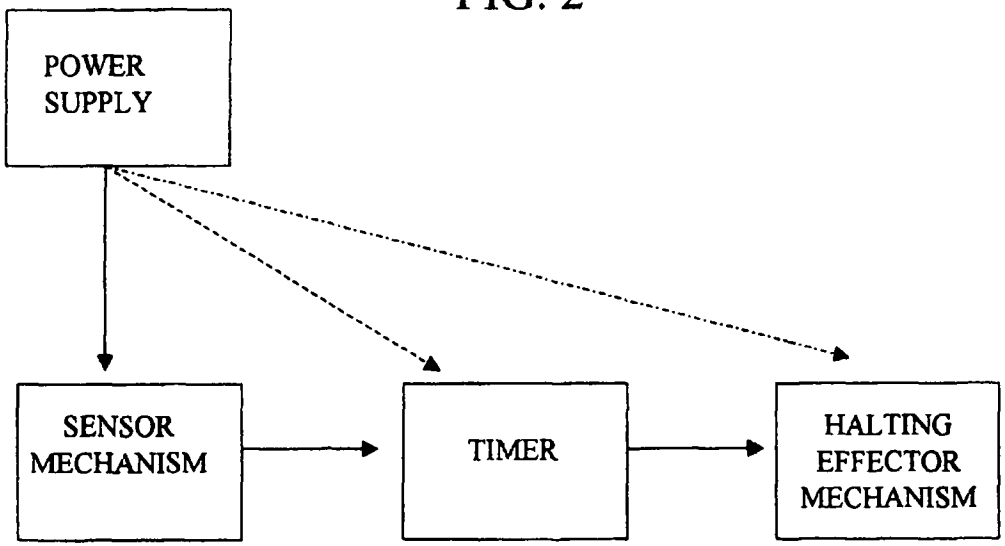
FIG. 2 shows a schematic of a preferred mechanism to inhibit for an amount of time movement of a movable surface on an apparatus in a direction at a certain distance traveled by the movable surface.

A schematic of the mechanism to trigger and inhibit unidirectional movement of the movable surface used in a preferred embodiment is illustrated in FIG. 2. FIG. 2 shows a schematic of a preferred mechanism for inhibiting the movable surface along the path of movement on the apparatus. The mechanism comprises: a power supply (preferably an electrical power source); a sensing mechanism; a timer; and a halting effector mechanism. The sensing mechanism, timer, and a halting effector mechanism may have their own power supply (dashed arrow lines). In a preferred embodiment the sensing mechanism, timer, and a halting effector mechanism are electrically coupled so that activation signals (solid arrow lines) flow from the sensing mechanism to the timer to the halting effector mechanism. The sensing mechanism determines the position of a movable surface and relays an appropriate activation signal, responsive to the position of the movable surface, to a timer. The timer then controls the duration or delay of an activation signal to a halting effector mechanism. The halting effector mechanism is a mechanism that provides for means of inhibiting the movement of the movable surface in a direction. The methods of inhibition of movement, in a direction, provided by the halting mechanism are: 1) mechanical inhibition; 2) requesting through an appropriate signal that such movement caused by an external applied force on the movable surface be reduced so as to halt any further movement in the direction caused by the external applied force; or 3) by the combination of both of the aforementioned methods. In a preferred embodiment the method of inhibition is mechanical.

The above-mentioned mechanism to trigger and inhibit the movement of the movable surface used in conjunction with this invention works in the following fashion: 1) as an external force is applied by a user of the apparatus to a movable surface linked to a resistance source, the sensing mechanism detects when the movable surface has traveled a certain distance (in the direction of the applied force and opposite the direction of resistance source force) and achieved a certain position along the range of motion of the exercise being performed; 2) upon ascertaining the position along the range of motion, the sensing mechanism sends an appropriate activation signal to a timer; 3) the timer then either delays in sending a signal to the halting effector mechanism or the timer sends a signal immediately to the halting effector mechanism for a given amount of time. The halting effector mechanism may: a) mechanically inhibit further movement of the surface in the direction of the external applied force; b) mechanically inhibit further movement of surface in the direction of the external applied force in combination with signaling for the cessation and immediate stasis of movement of the moveable surface for a given amount of time; or c) signal for the cessation and immediate stasis of movement of the moveable surface for a given amount of time.

The sensing mechanism may comprise but is not limited to: a bar code reader and a processor; a mechanical sensor switch; an interrupter sensor or an interrupter coupled sensor. In a preferred embodiment the sensing mechanism comprises an interrupter sensor. The timer of a preferred embodiment is an interval timer. The halting effector mechanism may comprises but is not limited to: an electric drum brake; an electric clamp brake; a solenoid with a retractable pin; an electric drum brake and a cessation of movement signal; an electric clamp brake and a cessation of movement signal; a solenoid with a retractable pin and a cessation of movement signal; and a cessation of movement signal; a clamp-like device which wraps around the tether and allows the tether to pass through freely, but blocks protrusions, knots, balls beads or such the like, affixed to the tether from passing (such device could also act as a sensor). The halting effector mechanism of a preferred embodiment comprises an electric drum brake.

The sensing mechanism may also use an electromagnetic reader and a processor, a sonic reader sand a processor or such the like so as to interpret the position of the movable surface and send an appropriate signal to a timer and halting effector mechanism. The sensor may be on a fixed or movable surface. The sensor may also function as a halting effector. The sensing mechanism may directly sense the position that the movable surface is in an send an appropriate signal or it may sense the position that the movable surface is in indirectly, by using other parts of or associated with the apparatus which correspond to the position ascertained by the movable surface.

Interrupter Sensor Activated—Wheel Type

In a first version of the preferred embodiment of this invention, the invention is an exercise machine, which comprises a mechanism for allowing the machine to inhibit in intervals along a range of motion for an amount of time, movement in a direction caused by an external force applied to a movable surface on the machine while allowing movement of the surface in the opposite direction to the external force. In the version the external force is the force applied by a user of the machine to a surface on the machine, which is linked to a resistance source. In the version; the movement of the movable surface under discussion is in opposite the direction of the resistance source's force. The location of the inhibition mechanism is illustrated in FIG. 1A.

Figure 3A:
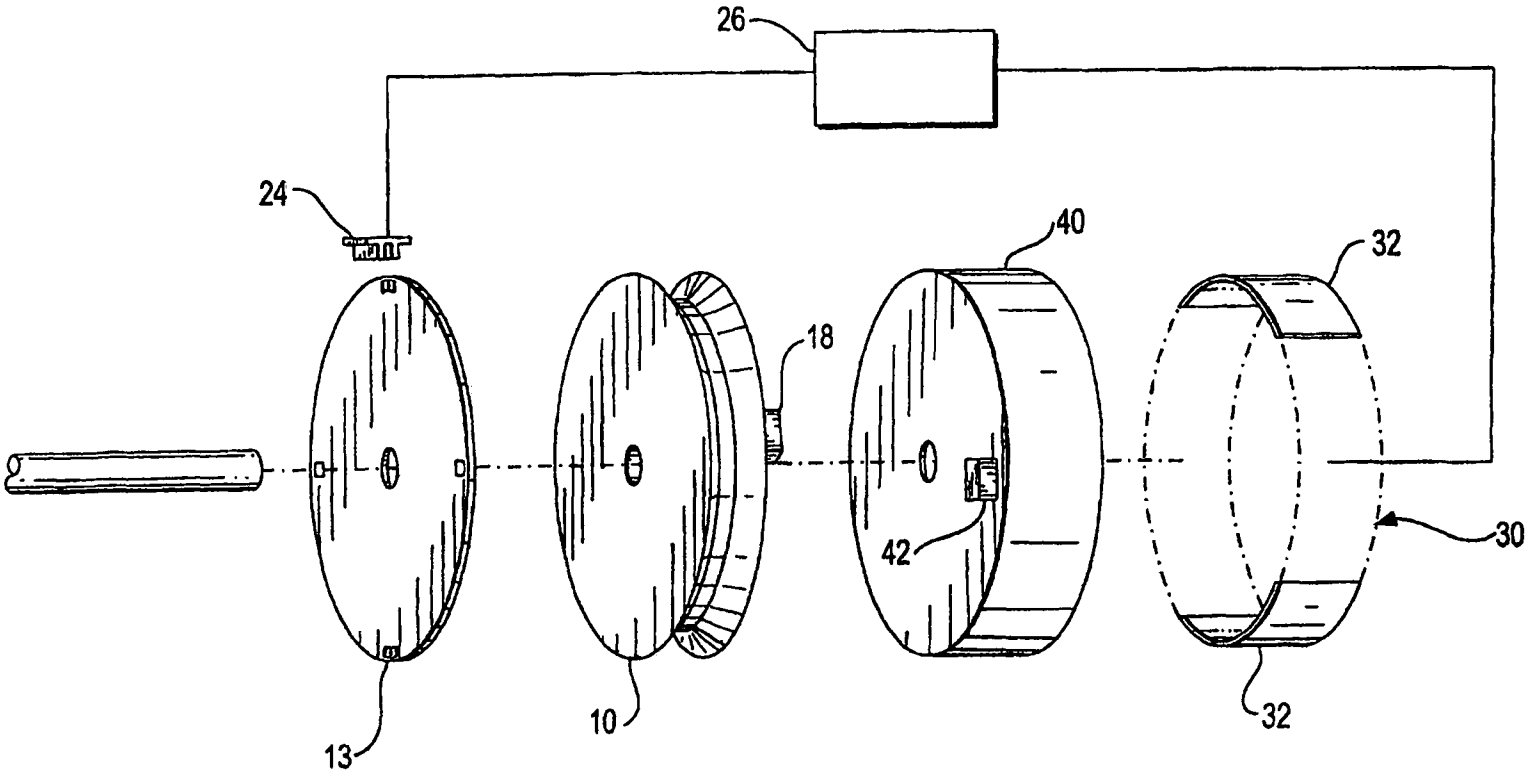
FIGS. 3A to 3I shows components of an opto interrupter sensor activated mechanism, which is used as a means of isometric and incremental contractions along a range of motion for a given exercise in a resistance machine.
Figure 3B:
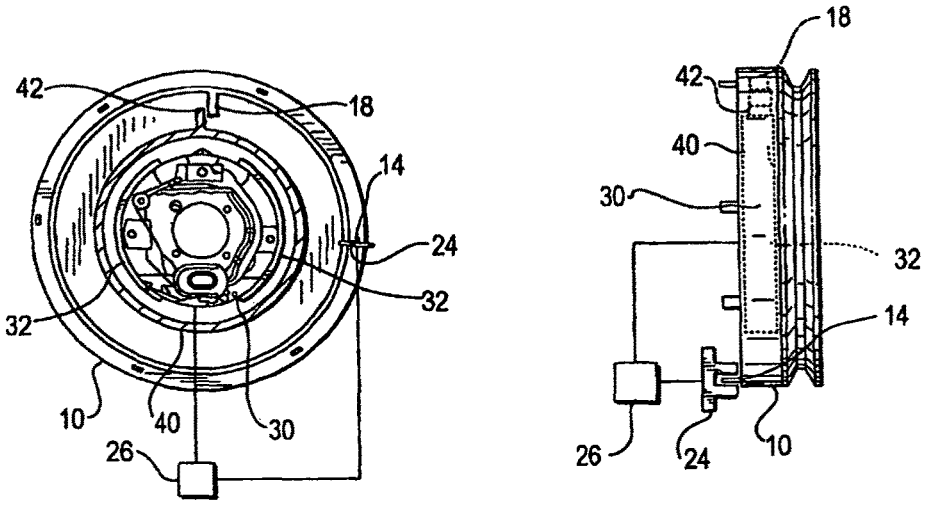

In the first version and in accordance with the diagram illustrated in FIG. 2, the exercise machine comprises the mechanism illustrated in FIGS. 3A and 3B. The outer wheel 10 is a pulley. The outer wheel 10 may be grooved to allow a cable tether or belt tether to sit in the groove or sprocketed to hold a chain tether or such the physical like. In an embodiment, the outer wheel 10 contains a sensor detectable protrusion 14, as in FIG. 3B. The sensor detectable protrusion 14 may be affixed on the top or sides of the outer wheel 10, the brake drum 40, the tether or be situated on any moving part that moves in relation to the movement of the movable surface or be situated on a stationary part. In FIG. 3A a preferred embodiment, an opto interrupter sensor triggering disc 13 is used and affixed to the side of the outer wheel 10. The opto interrupter sensor triggering disc 13 rotates its slotted and unslotted portions through the sensor, thereby activating and deactivating the sensor. An opto interrupter sensor 24 is placed so as to allow the sensor detectable protrusion 14 or opto interrupter sensor triggering disc 13, to pass through as the outer wheel 10 rotates. The opto interrupter sensor 24 is linked electrically to an interval timer 26. The interval timer 26 is linked electrically to the halting effector mechanism. A preferred halting effector mechanism comprises an electric drum braking mechanism, although the braking mechanism may be a hydraulic, pneumatic or mechanical. A disc brake mechanism may also be used. In version an electric brake 30 is located within the brake drum 40. The brake drum 40 also contains a low-tension recoil spring 44 to maintain an interface between the inner inhibitory contact plate 42 and the outer inhibitory contact plate 18. The inner inhibitory contact plate 42 is affixed to the brake drum 40. The outer inhibitory contact plate 18 is affixed to the outer wheel 10. The plates are oriented such that the inner inhibitory contact plate 42 is directly blocking the path of the outer inhibitory contact plate 18 in the direction of the user's applied force.

In the first version, the outer wheel 10 rotates the sensor detectable protrusion 14, FIG. 2B, or the opto interrupter sensor triggering disc 13, FIG. 3A, through the opto interrupter sensor 24 triggering the timer and halting effector mechanism. As the sensor detectable protrusion 14 or the opto interrupter sensor triggering disc 13 passes through the opto interrupter sensor 24, the sensor sends an appropriate signal to the interval timer 26. The interval timer 26 controls the duration of the activating signal to the electric brake 30. Once the electric brake 30 is activated, the brake shoes 32 of the electric brake 30 presses against the freely-rotatable brake drum 40, preventing movement of the brake drum 40. The electric brake 30 is affixed so as to be able to stop the rotation of the brake drum 40. The inner inhibitory contact plate 42, which is affixed to the brake drum 40, inhibits the outer inhibitory contact plate 18 affixed to the outer wheel 10. The outer wheel 10 is inhibited from movement in one direction but not the other. Once the signal transmitted by the interval timer 26 is terminated, the electric brake 30 is released and movement of the outer wheel 10 is allowed in either direction.

Figure 3C:
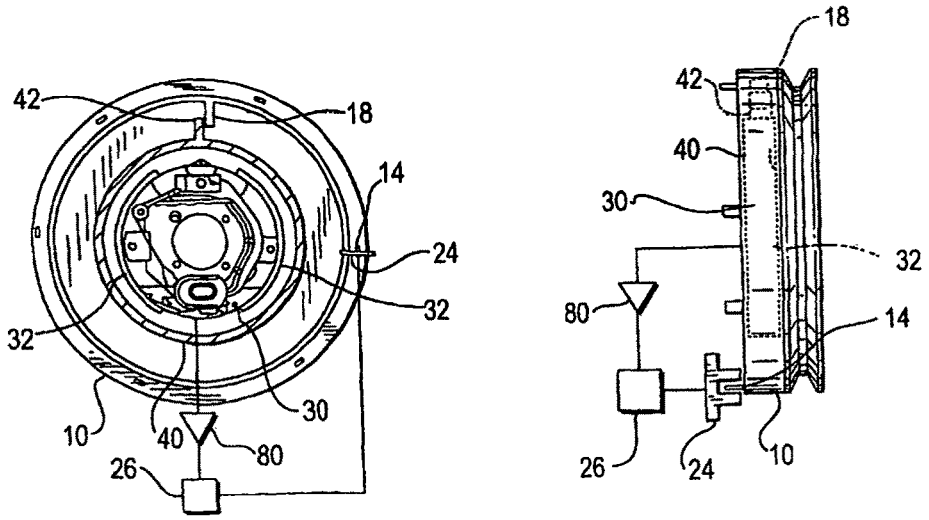

Opto Interrupter Sensor Activated Electric Brake and Activity Indicator Plus Interval Timer—Wheel Type In a version (a) of the first version of the preferred embodiment of this invention, FIG. 3C, the interval timer 26 is electrically linked to an activity inhibition indicator 80. The activity inhibition indicator 80 is connected to the electric brake 30.

The interval timer 26 controls the duration of the activating signal to the activity inhibition indicator 80 and the electric brake 30. The electric brake is activated as the activating signal passes through the activity inhibition indicator 80. The activity inhibition indicator 80 may also indicate the duration of the electric brake activation.

Figure 3D:
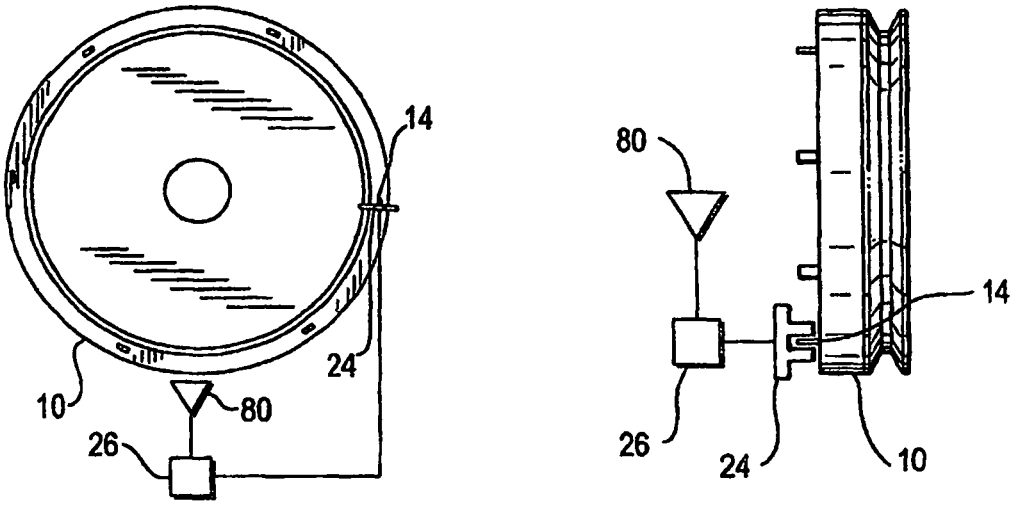

Opto Interrupter Sensor Activated Activity Indicator Plus Interval Timer—Wheel Type In a version (b) of the first version of the preferred embodiment of this invention, FIG. 3D, the interval timer 26 is electrically linked to an activity inhibition indicator 80, and there is no braking mechanism used in the system.

The interval timer 26 controls the duration of the activating signal to the activity inhibition indicator 80.

Interrupter Sensor Activated—Tube Type

Figure 3E:
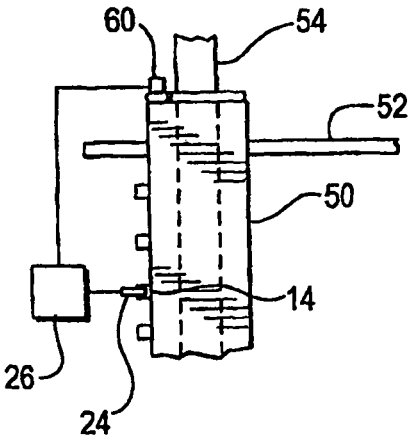

In a second version of the preferred embodiment of this invention and in accordance with the diagram illustrated in FIG. 2, the exercise machine comprises the mechanism illustrated in FIG. 3E. The sleeve 50 is connected to the movable surface where the user applies a force. In the version the surface is on a horizontal bar 52. The horizontal bar 52 is also linked to a resistance source. In this version, the resistance source is free weights. The sleeve 50 also contains a sensor detectable protrusion 14. The sensor detectable protrusion 14 is affixed the side of the sleeve 50 but may be situated on any moving part that moves in relation to the movement of the movable surface or be situated on a stationary part. An opto interrupter sensor 24 is placed so as to allow the sensor detectable protrusion 14 to pass through as the sleeve 50 moves the sensor detectable protrusion 14 through the opto interrupter sensor 24. The opto interrupter sensor 24 is connected to an interval timer 26. The interval timer 26 is connected to a halting effector mechanism. The halting effector mechanism comprises an electric clamp brake 60. The electric clamp brake 60 is located on the top of the sleeve 50. The electric clamp brake 60 moves freely on the sleeve guide 54 when not activated.

In this second version, as the sleeve 50, which contains the sensor detectable protrusion 14, moves the sensor detectable protrusion 14 through the opto interrupter sensor 24, the inhibition mechanism is triggered, thus preventing movement of the sleeve 50 in the direction of the force being applied by the user and contrary to the direction of the resistance source's force. As the sensor detectable protrusion 14 passes through the opto interrupter sensor 24, the sensor detects the sensor detectable protrusion 14 and then sends an appropriate signal to the interval timer 26. The opto interrupter sensor 24 is affixed so that the opto interrupter sensor 24 may detect the sensor detectable protrusion 14. The interval timer 26 controls the duration of the activating signal to the electric clamp brake 60. Once the electric clamp brake 60 is activated, the electric clamp brake 60 presses against the sleeve guide 54, preventing movement of the sleeve 50 in the direction of the user's force. Once the signal transmitted by the interval timer 26 is terminated, the electric clamp brake 60 is released and movement of the sleeve 50 is allowed in either direction.

Figure 3F:
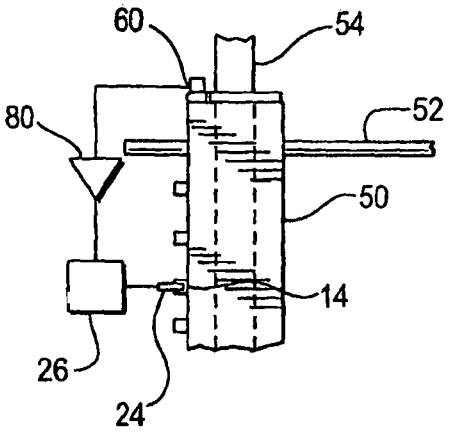

Opto Interrupter Sensor Activated Electric Brake and Activity Indicator Plus Interval Timer—Tube Type In a version (a) of the second version of the preferred embodiment of this invention, FIG. 3F, the interval timer 26 is electrically linked to an activity inhibition indicator 80. The activity inhibition indicator 80 is connected to the electric clamp brake 60.

The interval timer 26 controls the duration of the activating signal to the activity inhibition indicator 80 and the electric brake 30.

Figure 3G:
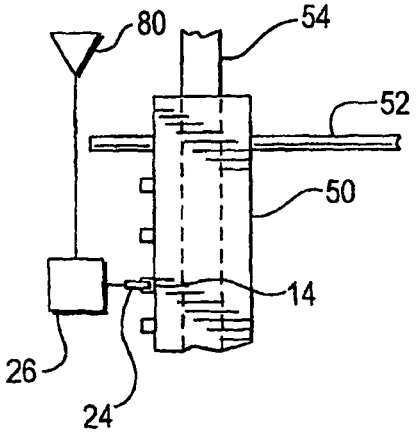

Opto Interrupter Sensor Activated Activity Indicator Plus Interval Timer—Tube Type In a version (b) of the second version of the preferred embodiment of this invention, FIG. 3G, the interval timer 26 is electrically linked to an activity inhibition indicator 80, and there is no braking mechanism used in the system.

The interval timer 26 controls the duration of the activating signal to the activity inhibition indicator 80.

Opto Interrupter Sensor Activated—Pin Mechanism

Figure 3H:
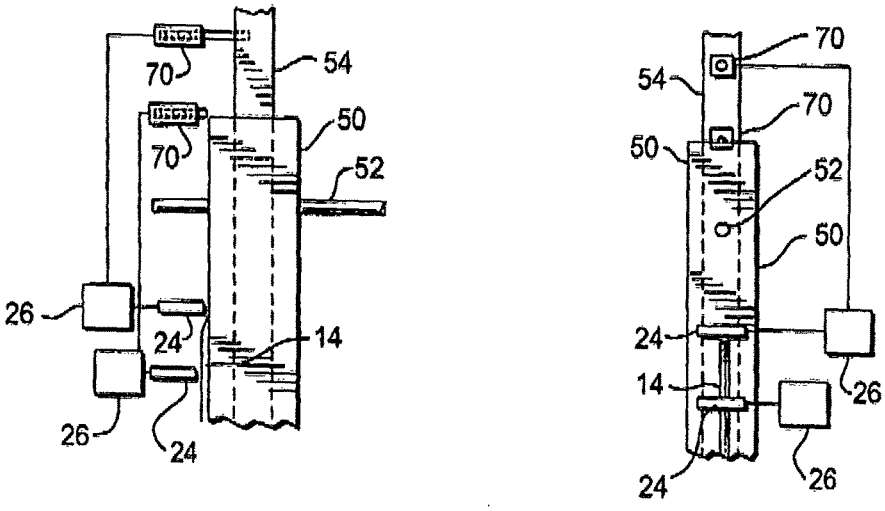
Figure 3I:
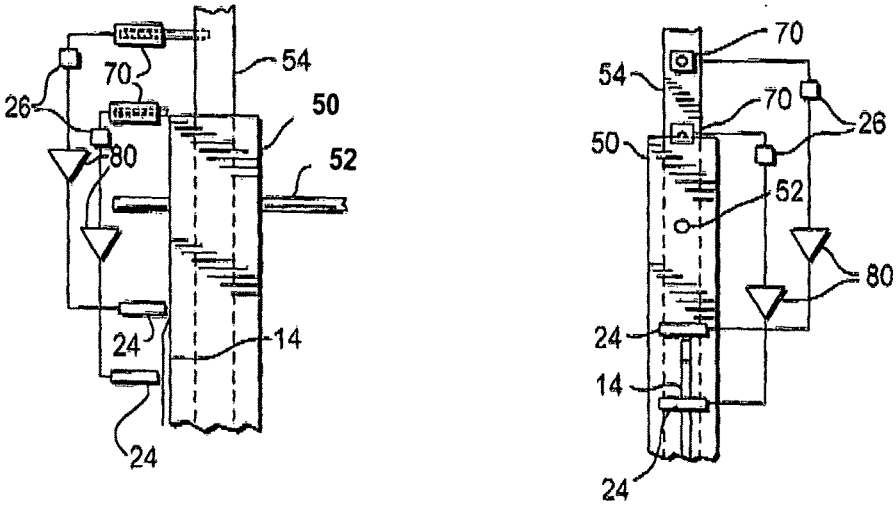

In a third version of the preferred embodiment of this invention and in accordance with the diagram illustrated in FIG. 2, the exercise machine contains the mechanism illustrated in FIG. 3H. The sleeve 50 is connected to the movable surface where the user applies a force. The movable surface on a horizontal bar 52. The horizontal bar 52 is also linked to a resistance source. In this version, the resistance source is free weights. The sleeve 50 also contains a sensor detectable protrusion 14. The sensor detectable protrusion 14 is affixed to the side of the sleeve 50 but may be situated on any moving part that moves in relation to the movement of the movable surface or be situated on a stationary part. An opto interrupter sensor 24 is placed so as to allow the sensor detectable protrusion 14 to pass through as the sleeve 50 moves the sensor detectable protrusion 14 through the opto interrupter sensor 24. The opto interrupter sensor 24 is connected to an interval timer 26. The interval timer 26 is connected to a solenoid 70. The solenoid 70 controls a pin that protrudes into the sleeve guide 54 and is retractable.

In the third version as the sleeve 50, which contains the sensor detectable protrusion 14, moves the sensor detectable protrusion 14 through the opto interrupter sensor 24, the mechanism is triggered. As the sensor detectable protrusion 14 passes through the opto interrupter sensor 24, the sensor detects the sensor detectable protrusion 14 and then sends an appropriate signal to the interval timer 26. The opto interrupter sensor 24 is affixed so that the opto interrupter sensor 24 may detect the sensor detectable protrusion 14. The interval timer 26 controls the length of time the inhibition of movement, caused by the blockage of the retractable pin, will last. Once the interval timer 26 activates the solenoid 70, the retraction of the pin occurs and movement of the sleeve 50 in the direction of the user's force is restored.

Opto Interrupter Sensor Activated Activity Inhibition Indicator Plus Interval Timer—Pin Mechanism In a version (a) of the third version of the preferred embodiment of this invention, FIG. 31, the interval timer 26 is electrically linked to an activity inhibition indicator 80. The activity inhibition indicator 80 is connected in between the interval timer 26 and the opto interrupter sensor 24.

In the version, the interval timer 26 controls the duration of the activating signal to the activity inhibition indicator 80 and the halting mechanism.

Bar Code Sensor Activated—Wheel Type

Figure 4A:
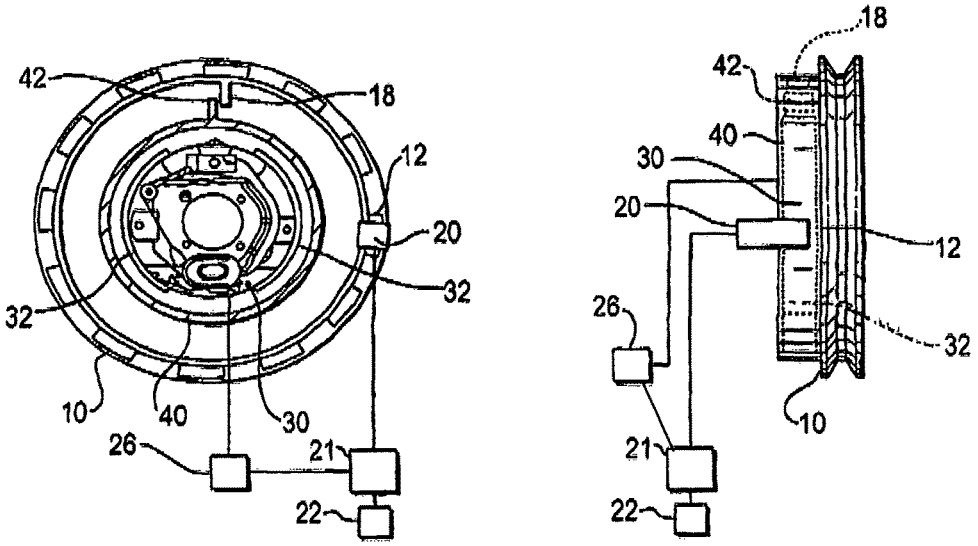
FIG. 4A to 4H shows components of a bar code sensor activated mechanism, which is used as a means of isometric and incremental contractions along a range of motion for a given exercise in a resistance machine.

In a forth version of the preferred embodiment of this invention, the exercise machine comprises the mechanism illustrated in FIG. 4A. This mechanism uses a bar code sensor to activate the inhibition of movement of the movable surface for an amount of time. In this version, the outer wheel 10 contains a code, which is read by a reader. In the version the code is a bar code 12. A bar code reader 20 reads the bar code 12. The bar code reader 20 is connected to a processor 21, which can process the information retrieved by the bar code reader 20 and send an appropriate downstream activation signal. The user-defined input 22 is also connected to the processor 21. The processor 21 may contain and program its own timer. In this version the processor 21 is connected to an interval timer 26. The interval timer 26 is connected to an appropriate halting effector mechanism. The halting effector mechanism comprises an electric drum braking mechanism. The braking mechanism may also be a disc brake. An electric brake 30 is located within the brake drum 40. The brake drum 40 also contains a recoil spring 44 to keep a constant contact between the inner inhibitory contact plate 42 and the outer inhibitory contact plate 18. The inner inhibitory contact plate 42 is affixed to the brake drum 40. The outer inhibitory contact plate 18 is affixed to the outer wheel 10. The plates are oriented such that the inner inhibitory contact plate 42 is directly blocking the path of the outer inhibitory contact plate 18 in the direction of the user's applied force.

In the forth version the bar code reader 20 reads the bar code 12, which then sends the acquired data to the processor 21. The bar code reader 20 is affixed so as to be able to read the bar code. The information from the user-defined input 22 is acquired by the processor. The processor 21 compares the users criterion for the number of stops required during the range of motion for the exercise on the machine with the predetermined positions given to the user's stop criterion. Once a corresponding bar code, based on the match with the user's input, is read by the bar code reader 20, the processor 21 sends an appropriate activating signal to an interval timer 26, and then the interval timer 26 sends an appropriate activating signal to the halting effector mechanism. The interval timer 26 determines the duration of the signal to the electric braking mechanism. Once the electric brake 30 is activated, the brake shoes 32 of the electric brake 30 presses against the freely-rotatable brake drum 40, preventing movement of the brake drum 40. The electric brake 30 is affixed so as to be able to stop the rotation of the brake drum 40. The inner inhibitory contact plate 42, which is affixed to the brake drum 40, contacts the outer inhibitory contact plate 18 affixed to the outer wheel 10. The outer wheel 10 is inhibited from movement in one direction but not the other. Once the signal transmitted by the interval timer 26 is terminated the electric brake 30 is released and movement of the outer wheel 10 is allowed in either direction until the bar code reader 20 reads another predetermined bar code 12.

Figure 4B:
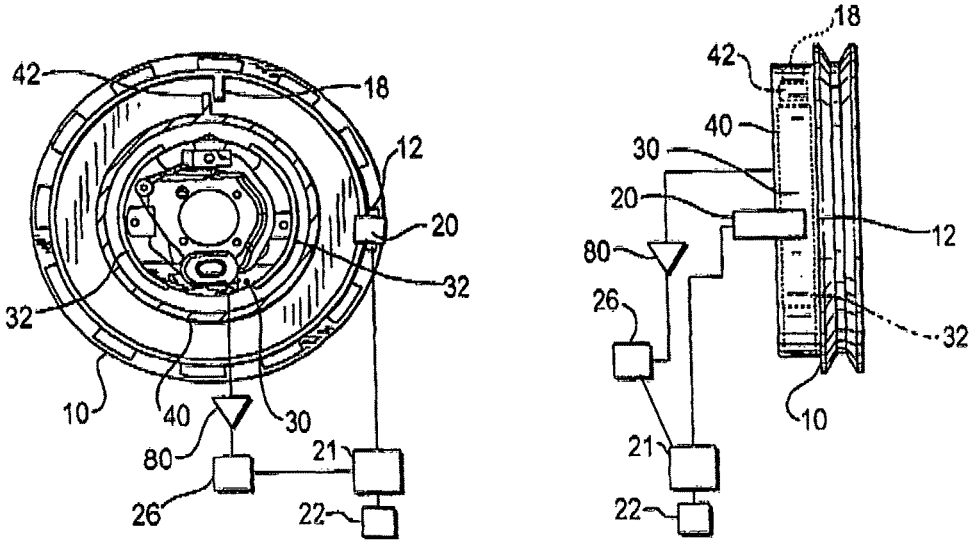

Bar Code Sensor Activated Electric Brake and Activity Inhibition Indicator Plus Interval Timer—Wheel Type In a version (a) of the forth version of the preferred embodiment of this invention, FIG. 4B, the interval timer 26 is electrically linked to an activity inhibition indicator 80. The activity inhibition indicator 80 is connected to the electric brake 30.

In the version, the interval timer 26 controls the duration of the activating signal to the activity inhibition indicator 80 and the electric brake 30.

Figure 4C:
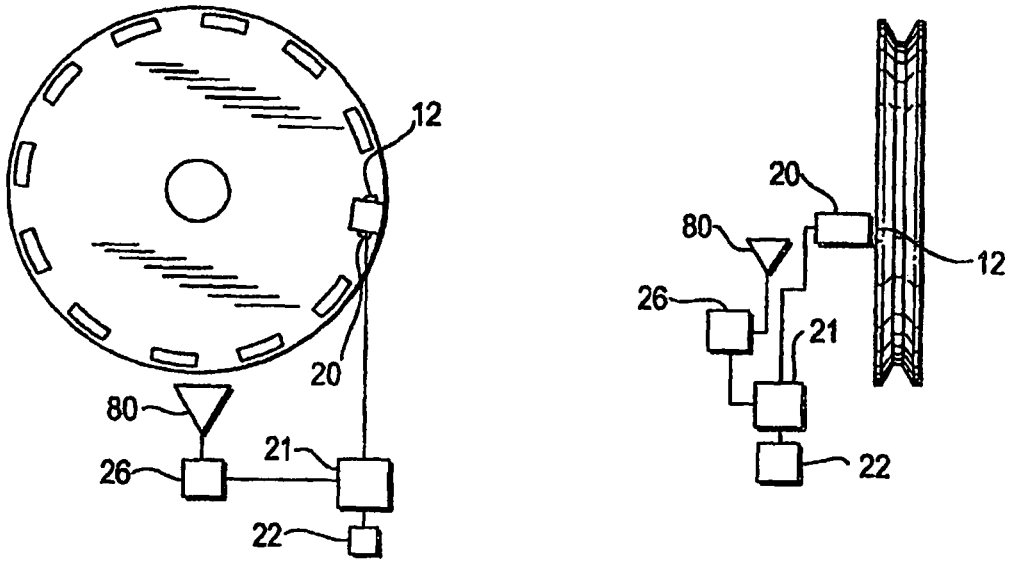

Bar Code Sensor Activated Activity Inhibition Indicator Plus Interval Timer—Wheel Type In a version (b) of the forth version of the preferred embodiment of this invention, FIG. 4C, the interval timer 26 is electrically linked to an activity inhibition indicator 80, and there is no braking mechanism used in the system.

The interval timer 26 controls the duration of the activating signal to the activity inhibition indicator 80.

Bar Code Activated—Tube Type

Figure 4D:
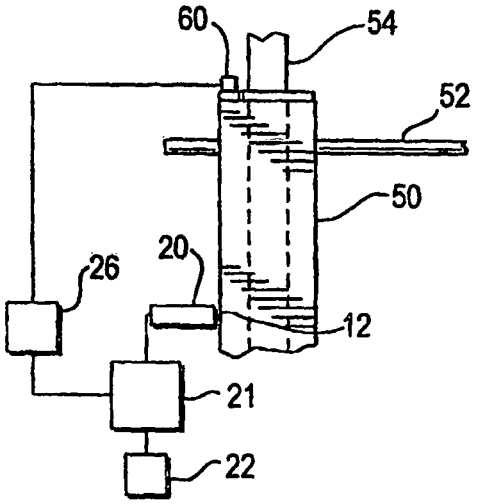

In a fifth version of the preferred embodiment of this invention and in accordance with the diagram illustrated in FIG. 2, the exercise machine comprises the mechanism illustrated in FIG. 4D. The sleeve 50 is connected to the movable surface where the user applies a force. In this version the surface is on a horizontal bar 52. The horizontal bar 52 is also linked to a resistance source; here, the resistance source placed on the horizontal bar 52 are free weights. The sleeve 50 also contains a code, which is read by a reader. The appropriate code triggers the mechanism. In this version the code is a bar code 12. A bar code reader 20 reads the bar code 12. The bar code readers 20 is connected to a processor 21, which can process the information retrieved by the bar code reader 20 and send an appropriate downstream activation signal. The user-defined input 22 is also connected to the processor 21. The processor 21 may contain and program its own timer. In the version the processor 21 is connected to an interval timer 26. The interval timer 26 is connected to a halting effector mechanism. The halting effector mechanism comprises an electric clamp braking mechanism. The electric clamp brake 60 is located on the top of the sleeve 50. The electric clamp brake 60 moves freely on the sleeve guide 54 when not activated.

In the fifth version, the bar code on the sleeve 50 is read by the bar code reader 20 which triggers the activation of the mechanism. The bar code reader 20 reads the bar code 12, which then sends the acquired data to the processor 21. The bar code reader 20 is affixed so as to be able to read the bar code 12. The information from the user-defined input 22 is acquired by the processor 21. The processor 21 compares the user's criterion for the number of stops required during the range of motion for the exercise on the machine with the predetermined positions given to the user's stop criterion. Once the bar code reader 20 reads a corresponding bar code 12, based on the match with the user's input, the processor 21 sends a signal to an interval timer 26, and then the interval timer 26 sends a signal to the electric clamp brake 60. The interval timer 26 determines the duration of the signal to the electric clamp brake 60. Once the electric clamp brake 60 is activated, the electric clamp brake 60 presses against the sleeve guide 54, preventing movement of the sleeve 50 in the direction of the user's force. Once the signal transmitted by the interval timer 26 is terminated, the electric clamp brake 60 is released and movement of the sleeve 50 is allowed in either direction.

Figure 4E:
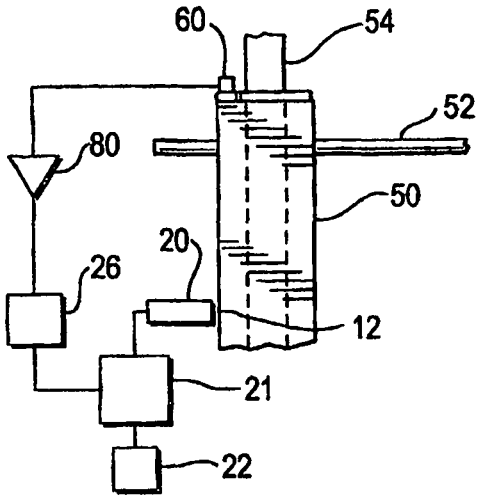

Bar Code Sensor Activated Electric Brake and Activity Inhibition Indicator Plus Interval Timer—Tube Type In a version (a) of the fifth version of the preferred embodiment of this invention, FIG. 4E, the interval timer 26 is electrically linked to an activity inhibition indicator 80. The activity inhibition indicator 80 is connected to the electric clamp brake 60.

In this version, the interval timer 26 controls the duration of the activating signal to the activity inhibition indicator 80 and the electric clamp brake 60.

Figure 4F:
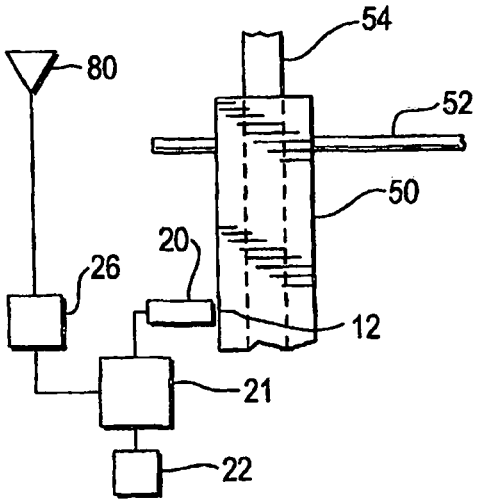

Bar Code Sensor Activated Activity Inhibition Indicator Plus Interval Timer—Tube Type In a version (b) of the fifth version of the preferred embodiment of this invention, FIG. 4F, the interval timer 26 is electrically linked to an activity inhibition indicator 80, and there is no braking mechanism used in the system.

The interval timer 26 controls the duration of the activating signal to the activity inhibition indicator 80.

Bar Code Activated—Pin Mechanism

Figure 4G:
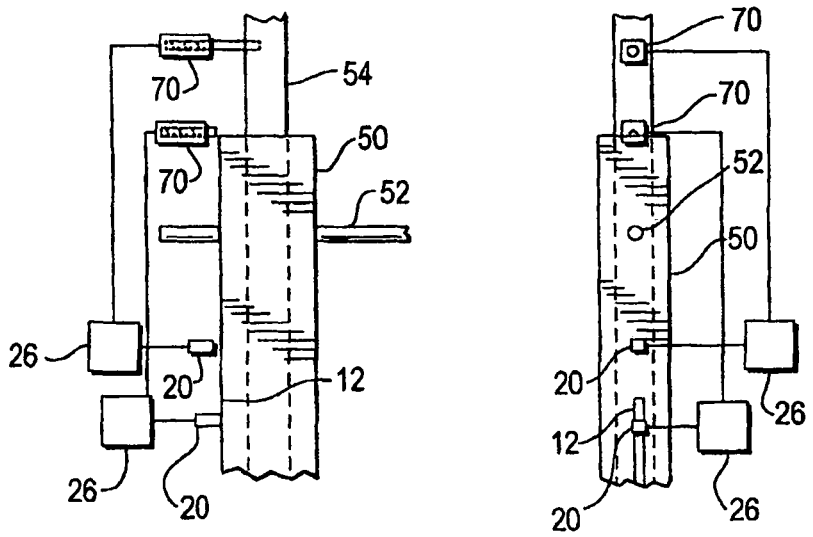
Figure 4H:
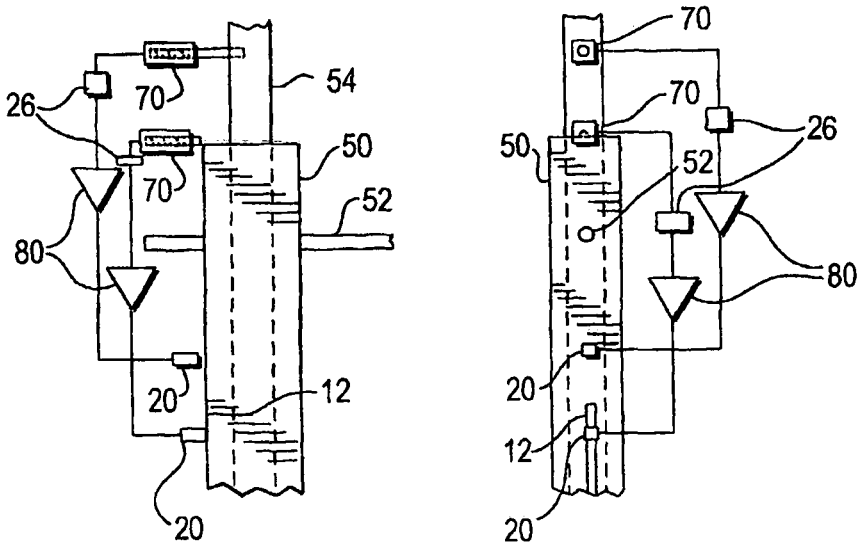

In a sixth version of the preferred embodiment of this invention and in accordance with the diagram illustrated in FIG. 2, the exercise machine contains the mechanism illustrated in FIG. 4G. The sleeve 50 is connected to a horizontal bar 52. The horizontal bar 52 is also linked to a resistance source. The resistance source placed on the horizontal bar 52 is free weights. The sleeve 50 also contains a code, which is read by a reader. In the version the code is a bar code 12. A bar code reader 20 reads the bar code 12. The bar code reader 20 can process the information retrieved by the bar code reader 20 and send a downstream activation signal or may be connected to processor. The bar code reader 20 is connected to an interval timer 26. The interval timer 26 is connected to a solenoid 70. The solenoid 70 controls a pin that protrudes into the sleeve guide 54 and is retractable.

In the sixth version the bar code 12 on the sleeve 50 is read by the bar code reader 20. The bar code reader 20 reads the bar code 12, and then sends the acquired data and processes the information The bar code reader 20 is affixed so as to be able to read the bar code 12. Once the bar code reader 20 reads the bar code 12, it sends an appropriate signal to the interval timer 26. The interval timer 26 controls the length of time the inhibition of movement caused by the blockage of the retractable pin will last. Once the interval timer 26 activates the solenoid 70, the retraction of the pin occurs and movement of the sleeve 50 in the direction of the user's force is restored.

Bar Code Sensor Activated Activity Inhibition Indicator Plus Interval Timer—Pin Mechanism In a version (a) of the sixth version of the preferred embodiment of this invention, FIG., 4H, the interval timer 26 is electrically linked to an activity inhibition indicator 80.

The activity inhibition indicator 80 is connected in between the interval timer 26 and the bar code reader 20.

In the version, the interval timer 26 controls the duration of the activating signal to the activity inhibition indicator 80 and the halting mechanism.

Mechanical Sensor Switch Activated—Wheel Type

Figure 5A:
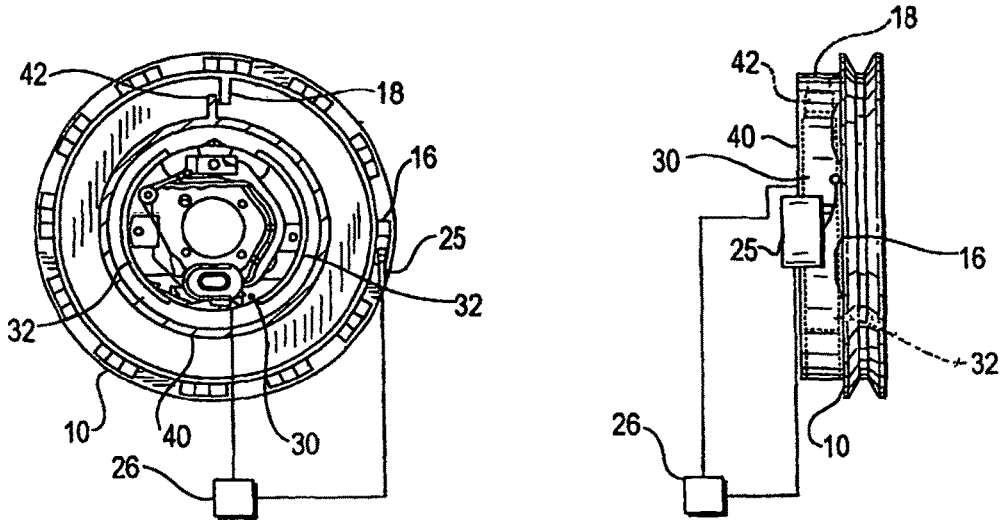
FIG. 5A to 5H shows components of a snap action sensor switch activated mechanism, which is used as a means of isometric and incremental contractions along a range of motion for a given exercise in a resistance machine.

In a seventh version of the preferred embodiment of this invention, the exercise machine comprises the mechanism illustrated in FIG. 5A. This mechanism uses a mechanical sensor switch to activate the inhibition of movement of the movable surface for an amount of time. In this version, the outer wheel 10 contains a switch activating protrusion 16. The switch activating protrusion 16 may be affixed on the top or sides of the outer wheel 10, brake drum 40, tether or be situated on any moving part that moves in relation to the movement of the movable surface or be situated on a stationary part. The mechanical sensor switch used is a snap action sensor switch 25. The snap action sensor switch 25 is placed so as to allow the switch activating protrusion 16 to activate the snap action sensor switch 25 as the outer wheel 10 rotates and passes the switch activating protrusion 16 by the snap action sensor switch 25. The snap action sensor switch 25 is connected to an interval timer 26. The interval timer 26 is connected to a halting mechanism. The halting mechanism comprises an electric braking mechanism. An electric brake 30 is located within a brake drum 40. The brake drum 40 also contains a low-tension recoil spring 44 to keep a constant between the inner inhibitory contact plate 42 and the outer inhibitory contact plate 18. The inner inhibitory contact plate 42 is affixed to the brake drum 40. The outer inhibitory contact plate 18 is affixed to the outer wheel 10. The plates are oriented such that the inner inhibitory contact plate 42 is directly blocking the path of the outer inhibitory contact plate 18 in the direction of the user's applied force.

As the outer wheel 10 rotates the switch activating protrusion 16 by the snap action sensor switch 25 the snap action sensor switch 25 is triggered. As the switch activating protrusion 16 passes under the snap action sensor switch 25, the snap action sensor switch 25 is activated by the switch activating protrusion 16. The snap action sensor switch 25 is affixed so that the snap action sensor switch 25 may be activated by the passing of the switch activating protrusion 16. The snap action sensor switch 25 then sends an appropriate activating signal to the interval timer 26. The interval timer 26 controls the duration of the activating signal to the electric brake 30. Once the electric brake 30 is activated, the brake shoes 32 of the electric brake 30 presses against the freely-rotatable brake drum 40, preventing movement of the brake drum 40. The electric brake 30 is affixed so as to be able to stop the rotation of the brake drum 40. The inner inhibitory contact plate 42, which is affixed to the brake drum 40, contacts the outer inhibitory contact plate 18 affixed to the outer wheel 10. The outer wheel 10 is inhibited from movement in one direction but not the other. Once the signal transmitted by the interval timer 26 is terminated the electric brake 30 is released and movement of the outer wheel 10 is allowed in either direction until the snap action sensor switch 25 is activated by another protrusion.

Figure 5B:
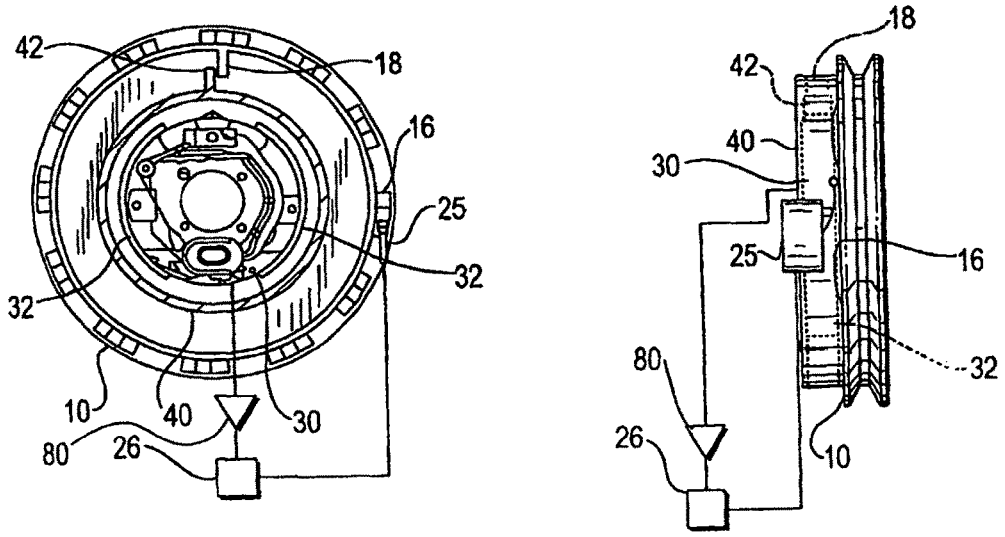

Mechanical Sensor Switch Activated Electric Brake and Activity Inhibition Indicator Plus Interval Timer—Wheel Type In a version (a) of the seventh version of the preferred embodiment of this invention, FIG. 5B, the interval timer 26 is electrically linked to an activity inhibition indicator 80. The activity inhibition indicator 80 is connected to the electric brake 30.

In the version, the interval timer 26 controls the duration of the activating signal to the activity inhibition indicator 80 and the electric brake 30.

Figure 5C:
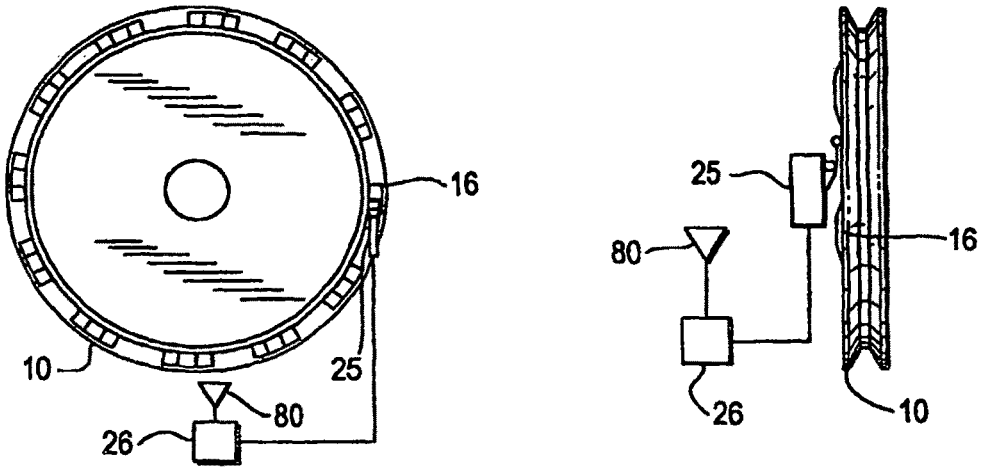

Mechanical Sensor Switch Activated Activity Inhibition Indicator Plus Interval Timer—Wheel Type In a version (b) of the seventh version of the preferred embodiment of this invention, FIG. 5C, the interval timer 26 is electrically linked to an activity inhibition indicator 80, and there is no braking mechanism used in the system.

The interval timer 26 controls the duration of the activating signal to the activity inhibition indicator 80.

Mechanical Sensor Switch Activated—Tube Type

Figure 5D:
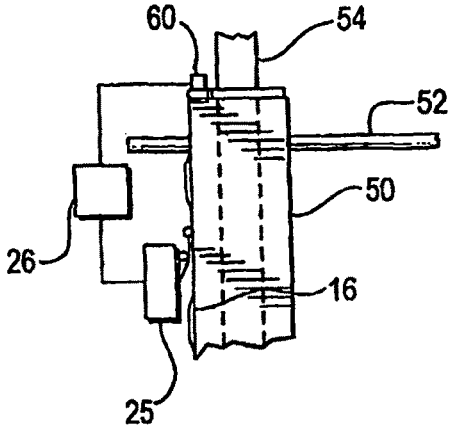

In an eighth version of the preferred embodiment of this invention and in accordance with the diagram illustrated in FIG. 2, the exercise machine contains the inhibition mechanism illustrated in FIG. 5D. The sleeve 50 is connected to the movable surface where the user applies a force. In this version the surface is on a horizontal bar 52. The horizontal bar 52 is also linked to a resistance source. In this version, the resistance source is free weights. The sleeve 50 contains a switch activating protrusion 16. The switch activating protrusion 16 is affixed the side of the sleeve 50, but may be situated on any moving part that moves in relation to the movement of the movable surface or be situated on a stationary part. The mechanical sensor switch is a snap action sensor switch 25. The snap action sensor switch 25 is placed so as to allow the switch activating protrusion 16 to activate the switch as the sleeve 50 moves the switch activating protrusion 16 by the switch. The snap action sensor switch 25 is connected to an interval timer 26. The interval timer 26 is connected to the halting effector mechanism. The halting effector mechanism comprises an electric clamp brake 60. The electric clamp brake 60 is located on the top of the sleeve 50. The electric clamp brake 60 moves freely on the sleeve guide 54 when not activated.

In the eighth version, the sleeve 50, which contains the switch activating protrusion 16, moves the switch activating protrusion 16 by the snap action sensor switch 25, the snap action sensor switch 25 is triggered. As the switch activating protrusion 16 passes under the snap action sensor switch 25, the snap action sensor switch 25 is activated by the switch activating protrusion 16. The snap action sensor switch 25 then sends an appropriate signal to the interval timer 26. The interval timer 26 controls the duration of the activating signal to the electric clamp brake 60. Once the electric clamp brake 60 is activated, the electric clamp brake 60 presses against the sleeve guide 54, preventing movement of the sleeve 50 in the direction of the user's force. Once the signal transmitted by the interval timer 26 is terminated, the electric clamp brake 60 is released and movement of the sleeve 50 is allowed in either direction.

Figure 5E:
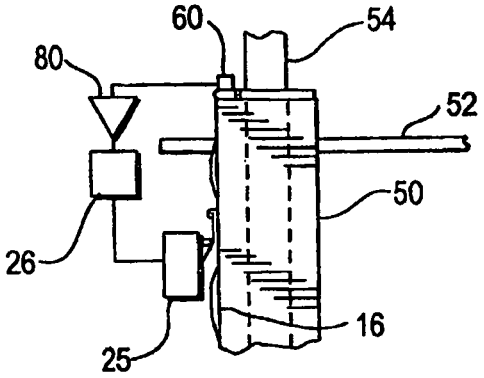

Mechanical Sensor Switch Activated Electric Brake and Activity Inhibition Indicator Plus Interval Timer—Tube Type In a version (a) of the eighth version of the preferred embodiment of this invention, FIG. 5E, the interval timer 26 is electrically linked to an activity inhibition indicator 80. The activity inhibition indicator 80 is connected to the electric clamp brake 60.

In the version, the interval timer 26 controls the duration of the activating signal to the activity inhibition indicator 80 and the electric clamp brake 60.

Figure 5F:
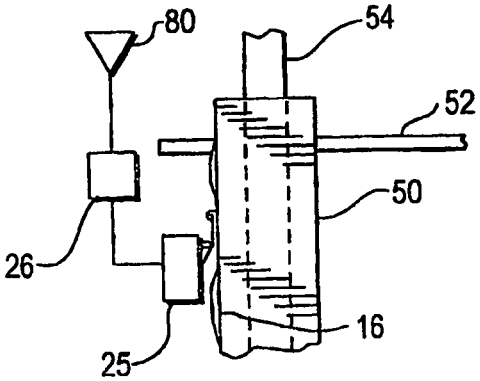

Mechanical Sensor Switch Activated Activity Inhibition Indicator Plus Interval Timer—Tube Type In a version (b) of the eighth version of the preferred embodiment of this invention, FIG. 5F, the interval timer 26 is electrically linked to an activity inhibition indicator 80, and there is no braking mechanism used in the system.

The interval timer 26 controls the duration of the activating signal to the activity inhibition indicator 80.

Mechanical Sensor Switch Activated—Pin Mechanism

Figure 5G:
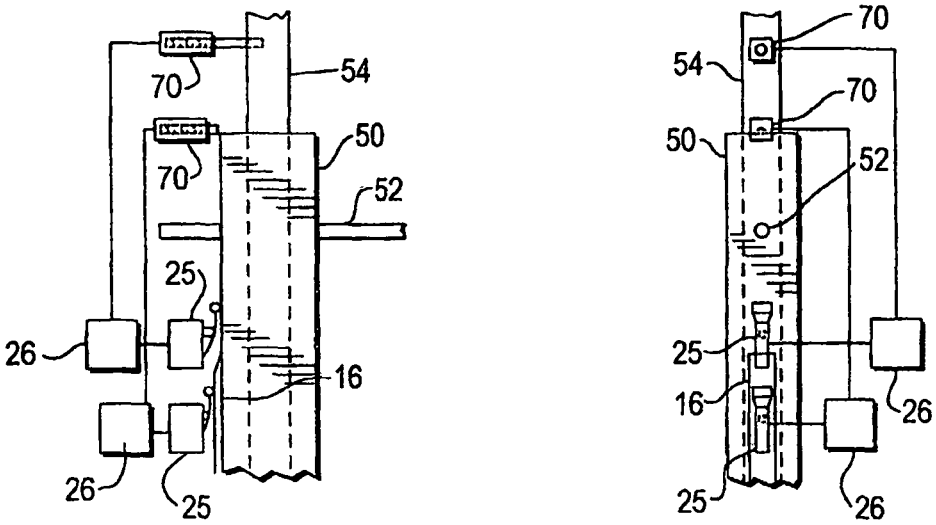

In a ninth version of the preferred embodiment of this invention and in accordance with the diagram illustrated in FIG. 2, the exercise machine contains the inhibition mechanism illustrated in FIG. 5G. The sleeve 50 is connected to a horizontal bar 52. The horizontal bar 52 is also linked to a resistance source. The resistance source is free weights. The sleeve 50 contains a switch activating protrusion 16. The switch activating protrusion 16 is affixed the side of the sleeve 50, but may be situated on any moving part that moves in relation to the movement of the movable surface or be situated on a stationary part. The mechanical sensor switch used is a snap action sensor switch 25. The snap action sensor switch 25 is placed so as to allow the switch activating protrusion 16 to activate the switch as the sleeve 50 moves the switch activating protrusion 16 by the switch. The snap action sensor switch 25 is connected to an interval timer 26. The interval timer 26 is connected to the halting effector mechanism. The halting effector mechanism comprises a solenoid 70. The solenoid 70 controls a pin that protrudes into the sleeve guide 54 and is retractable.

In the ninth version as the switch activating protrusion 16 passes under the snap action sensor switch 25, the snap action sensor switch 25 becomes activated. The snap action sensor switch 25 is affixed so that the snap action sensor switch 25 may be activated by the passing switch activating protrusion 16. The snap action sensor switch 25 then sends an appropriate signal to the interval timer 26. The interval timer 26 is then triggered. The interval timer 26 controls the length of time the inhibition of movement caused by the blockage of the retractable pin will last. Once the interval timer 26 activates the solenoid 70, the retraction of the pin occurs and movement of the sleeve 50 in the direction of the user's force is restored.

Figure 5H:
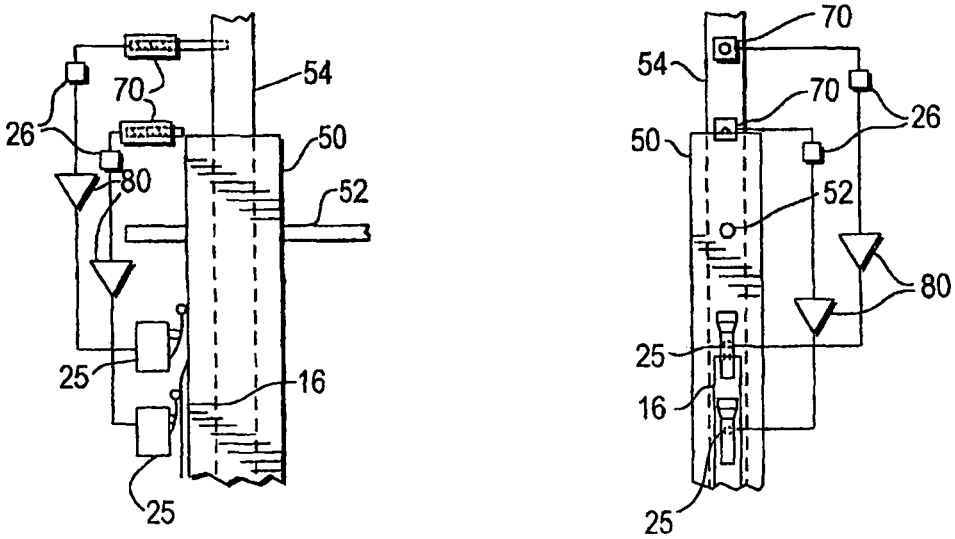

Mechanical Sensor Switch Activated Activity Inhibition Indicator Plus Interval Timer—Pin Mechanism In a version (a) of the ninth version of the preferred embodiment of this invention, FIG. 5H, the interval timer 26 is electrically linked to an activity inhibition indicator 80. The activity inhibition indicator 80 is connected in between the interval timer 26 and the snap action sensor switch 25.

The interval timer 26 controls the duration of the activating signal to the activity inhibition indicator 80 and the halting mechanism.

An electric clamp brake 60 is shown in FIG. 6. The electric clamp brake comprises a brake housing 61. The brake housing 61 holds the brake pad 62. The axis bolt 63 is the axis in which the clamp brake mechanism clamps on the sleeve guide 54. The brake arms 64 pushes out the brake housing 61 so as to apply the brake pad 62 to the sleeve guide 54. The brake arms are connected to the brake yolk 65. The brake yolk 65 is connected to the rotary solenoid 66. The rotary solenoid once activated turns the yolk and applies the brake pad 62 to the sleeve guide 54.

In a third embodiment of this invention, the invention is a resistance exercise machine which exercises the user's torso.

In forth embodiment of this invention, the invention is a resistance exercise machine which exercises the user's appendages.

In fifth embodiment of this invention, the invention is a resistance exercise machine which exercises the user's neck.

In sixth embodiment of this invention, the invention is a resistance exercise machine which exercises the user's head.

In seventh embodiment of this invention, the invention is a resistance exercise machine which exercises the user's digits.

In eighth embodiment of this invention, the invention is a resistance exercise machine which exercises the user's torso, appendages, neck, head or digits.

In a ninth embodiment of this invention and all the above-mentioned embodiments and versions of the invention, there exists neither sensor nor timer and a user-controlled switch controls the halting effector mechanism.

In a tenth embodiment of this invention, the invention is a combination resistance exercise machine, wherein the combination exercise machine is a bench press, a shoulder press, a pull down, a triceps press, a bicep curl, a hamstring curl and a leg extension.

In another embodiment of the first, forth and seventh versions, as well as their respective version (a)s, of the preferred embodiment of this invention, the halting effector mechanism comprises a stationary inner inhibitory contact plate 42, which is able to retract and protract. When the inner inhibitory contact plate 42 is protracted to contact the outer inhibitory contact plate 18, the inner inhibitory contact plate 42 is then able to inhibit the movement of the outer wheel 10. The inner inhibitory contact plate 42 may be retracted and protracted by a solenoid or a motor and can be attached to an unrotatable surface such as an unrotatable brake drum.

In one manner to achieve usage of this invention, the user of the machine applies a force to a resistance-linked surface, such as a bar, handle pad, mat or such the like, overcoming the resistance linked to the surface from a resistance source and causing the surface to move. As the surface moves in the direction of the force being applied by the user and contrary to the direction of the resistance source's force, the machine applies a halting effector mechanism after a sensing mechanism has detected a certain position attained by the surface along a range of motion of the movable surface. This halting effector mechanism indicates to inhibit or inhibits movement of the surface in the direction of the user's applied force, for an amount of time determined by the interval timer, while allowing movement in the opposite direction. During the inhibition of movement in the direction of the user's applied force, the user is required to hold the surface at the inhibition. The inhibition of movement occurs for an amount of time. Ideally, the amount of time may range from just a mere stop to an inhibition of 20 seconds or more. The inhibition of movement occurs in a stop and go fashion along the full range of motion of the exercise. Ideally, the amount of times to inhibit the motion over the range of motion of the exercise may be from 1 to 20 or more. After the inhibition in the direction of the user's applied force for the selected amount of time, the user then moves the surface to the next inhibition (if more than one inhibition is required) and continues the process until the end of the range of motion.

In an alternate embodiment of this invention, the halting effector mechanism is triggered by a timer intermittently regardless of the distance traveled by the movable surface.

In another alternate embodiment of this invention, the invention is an exercise machine where after the user has completed the positive part of a repetition on the exercise machine and begins to return the movable surface linked to a resistance source to its initial position, the machine inhibits movement in the direction of the force applied by the user for an amount of time at certain positions along the negative phase of the repetition.

In another alternate embodiment of this invention, the invention is an exercise machine where after the user has completed the positive part of a repetition on the exercise machine and begins to return the movable surface linked to a resistance source to its initial position, the machine signals to the user for an amount of time when the user achieves certain positions along the negative portion of the repetitions.

In another aspect of this invention, the invention provides for a method of using a resistance exercise machine that comprises a mechanism for allowing the apparatus to inhibit for an amount of time, movement of a movable surface on the machine in the direction caused by an external force applied to the movable surface, while the apparatus allows uninhibited movement of the movable surface in the opposite direction to the external force, and wherein the movable surface is linked to a resistance source which applies force which is diametric to the external applied force. This method comprises: a) contacting the movable with a body part; b) applying a force to the movable surface through the body part of a user as to cause the movable surface to move in a direction opposite the force from the resistance source; c) inhibiting for an amount of time the movement of the movable surface after a certain distance has been traveled by the movable surface in the direction caused by the applied force; d) removing the inhibition after the amount of time; and then e) moving the movable surface pass the certain distance that has been traveled, thereby using the resistance exercise machine.

In a third aspect of this invention, the invention provides a kit comprising parts for an apparatus such as a resistance exercise machine, which apparatus comprises a mechanism for allowing the apparatus to inhibit for an amount of time, movement of a movable surface on the apparatus in a direction caused by an external force applied to the movable surface, while the apparatus allows uninhibited movement of the movable surface in the opposite direction to the external force, and wherein the movable surface is linked to a resistance source which applies force which is diametric to the external applied force.

The kit may comprise: a) a sensing mechanism, to determine the position of a movable surface along the range of motion and to relay an appropriate signal, responsive to the position of the movable surface; b) a timer, wherein said timer controls the duration or delay of an activation signal; and c) a halting effector mechanism which inhibits the movement of the movable surface in one direction while allowing movement of the movable surface in the other direction.

This invention includes but is not limited to: a bench press machine, a military press machine, a triceps press machine, a pull down machine, a rowing machine, a dead-lift machine, a lower back extension machine, a shrug machine, a dip machine, a neck machine, a sit-up machine, an abdominal oblique machine, an abdominal crunch machine, a leg raise machine, a pull over machine, an abductor-adductor machine, a lateral raise machine, a bicep curl machine, a forearm curl machine, a forearm extensor machine, a grip machine, a rotator cuff machine, a triceps donkey kickback machine, a fly machine, a pectoral deck machine, a buttocks machine, a hamstring curl machine, a leg extension machine, a leg press machine, a squat machine, a calf raise machine, an anterior tibialis machine, a rear deltoid machine, a frontal deltoid raise machine, a torso rotator machine and a cable machine.

A resistance source includes but is not limited to weight stack, free weights, a flexible rod, a leverage system or such the like as to create an opposing resistance to the user's applied force.

A resistance exercise machine is an exercise machine with a resistance source linked to a movable surface.

A movable surface includes but is not limited to: the surface on bar, a pad, a mat, a handle, a strap, a rope, a belt or such the like wherein an entity or user of an exercise apparatus can place a body part and exert a force and move the surface in which there is contact.

A plate, a wheel, a disc or a plate may serve a similar function of the brake drum—that is to: move freely with the outer wheel; be capable of having its (the plate, the wheel, the disc or the plate) rotation inhibited; and have or affixed thereto a contact plate which interfaces with the outer wheel in such a manner as to inhibit movement of the outer wheel in one direction while allowing movement in the other direction when the rotation of the plate, the wheel, the disc or the plate is impeded.

Braking mechanism may use electrical, hydraulic, pneumatic or mechanical means, or a combination thereof for accomplishing its function.

The activity inhibition indicator includes but is not limited to: a light, a sound or such the like as to indicate to the user to reduce the external force being applied to the surface. The preferred activity inhibition indicator throughout is a light.

The code in this invention includes but is not limited to: information encoded in a bar code, an electromagnetic, magnetic or sonic encryption and be situated on any moving part that moves in relation to the movement of the movable surface or be situated on a stationary part. The code may also be affixed to a part, which can gauge the distance traveled by the movable surface.

A reader is a sensor which can read a certain code.

A tether includes but is not limited to: a wire cable, a chain, a belt, or the like connected to an attached resistance source and the movable surface.

External force is the force exerted by an entity other than the apparatus or machine itself. While using the disclosed apparatus, it is assumed that the external force is the force being exerted by the machine's user, through a bodypart of the user.

Although the description above contains several specificities, these should not be considered as limiting the scope of the invention but merely providing illustrations of some of the presently preferred embodiments of this invention. For example the halting effector mechanism may use a bladder type brake, a means of nudging the user when to halt movement, a sensing mechanism wherein the detection is based on a chemical interaction, the sensing mechanism is coupled with the timer, etc.

Therefore, the scope of this invention should be determined by the appended claims and their legal equivalents, rather than by the given examples.

What is claimed:

1. An exercise machine comprising:

a movable surface configured to move in a first direction in response to a force applied to the movable surface by a user;

a resistance source, associated with the movable surface, configured to apply a force on the movable surface in a second opposite direction;

a mechanism associated with the movable surface, comprising a sensing mechanism, the sensing mechanism configured to detect a position of the movable surface along a range of motion of the movable surface and to generate a signal in response to the movable surface reaching one or more predetermined positions within the range of motion;

wherein the mechanism is configured to a) inhibit, for a preselected amount of time, movement of the movable surface in the first direction, in response to the signal generated by the sensing mechanism, while allowing movement of the movable surface in the second opposite direction during the preselected amount of time; and b) allow, after the preselected amount of time has elapsed, further movement of the movable surface in the first direction, pass the one or more predetermined position.

2. The exercise machine of claim 1, wherein the exercise machine is a resistance exercise machine.

3. The exercise machine of claim 2, wherein the mechanism further comprises:

a timer configured to receive the generated signal from the sensing mechanism, and to generate an activation signal for the preselected amount of time; and a halting effector mechanism configured to receive the activation signal and to cause the inhibition of movement of the movable surface in response to the activation signal.

4. The exercise machine of claim 3, wherein the sensing mechanism comprises an opto interrupter sensor and means to activate the sensor.

5. The exercise machine of claim 3, wherein the halting effector mechanism comprises an activity inhibition indicator.

6. The exercise machine of claim 3, wherein the halting effector mechanism comprises an electrically activated brake.

7. The exercise machine of claim 6, wherein the halting effector mechanism further comprises an activity inhibition indicator to indicate that the movement in the first direction is inhibited.

8. The exercise machine of claim 3, wherein the exercise machine is used to exercise the torso of the user.

9. The exercise machine of claim 3, wherein the exercise machine is used to exercise the appendages of the user.

10. The exercise machine of claim 3, wherein the exercise machine is used to exercise the head of the user.

11. The exercise machine of claim 3, wherein the exercise machine is used to exercise the neck of the user.

12. The exercise machine of claim 3, wherein the exercise machine is used to exercise the digits of the user.

13. The exercise machine of claim 3, wherein the exercise machine is used to exercise the pelvis of the user.

14. The exercise machine of claim 3, wherein the exercise machine is a bench press machine.

15. The exercise machine of claim 3, wherein the exercise machine is a pull down machine.

16. The exercise machine of claim 3, wherein the exercise machine is a bicep curl machine.

17. The exercise machine of claim 3, wherein the exercise machine is a leg extension machine.

18. The exercise machine of claim 3, wherein the exercise machine is a Smith machine.

19. The exercise machine of claim 3, wherein the exercise machine is selected from the group consisting of: a military press machine, a triceps press machine, a rowing machine, a dead-lift machine, a lower back extension machine, a shrug machine, a dip machine, a neck machine, a sit-up machine, an abdominal oblique machine, an abdominal crunch machine, a leg raise machine, a pull over machine, an abductor-adductor machine, a lateral raise machine, a forearm curl machine, a forearm extensor machine, a grip machine, a rotator cuff machine, a triceps donkey kickback machine, a fly machine, a pectoral deck machine, a buttocks machine, a hamstring curl machine, a leg press machine, a squat machine, a calf raise machine, an anterior tibialis machine, a rear deltoid machine, a frontal deltoid raise machine, a torso rotator machine, and a cable machine.

20. A kit configured to be used with an exercise apparatus comprising a movable member moving in a first direction in response to a user's applied force, and a resistance source exerting a force to the movable member in a second opposite direction, the kit comprising:

a) a sensing mechanism, to determine a position of the movable surface along a range of motion and to relay an appropriate signal, responsive to determining that the movable surface has reached at least one predetermined position;

b) a halting effector mechanism configured to inhibit the movement of the movable surface in the first direction, for a preselected amount of time, while allowing movement of the movable surface in the second opposite direction during the preselected amount of time, and to remove inhibition of movement of the movable surface, after the preselected amount of time has elapsed, to allow further movement of the movable surface in the first direction pass the at least one predetermined position; and c) a timer, wherein said timer controls the preselected amount of time.

* * * * *